US005604011A

United States Patent [19]

Morley

[11] Patent Number: 5,604,011

[45] Date of Patent: Feb. 18, 1997

[54] EDGE PROTECTOR AND FITTED ARTICLE

[75] Inventor: Timothy C. Morley, Birmingham, Great Britain

[73] Assignee: Aston Packaging Limited, Birmingham, United Kingdom

[21] Appl. No.: 392,762

[22] PCT Filed: Aug. 25, 1993

[86] PCT No.: PCT/GB93/01813

§ 371 Date: Apr. 10, 1995

§ 102(e) Date: Apr. 10, 1995

[87] PCT Pub. No.: WO94/04430

PCT Pub. Date: Mar. 3, 1994

[30] Foreign Application Priority Data

Aug. 26, 1992 [GB] United Kingdom ..... 9218124

[51] Int. Cl.[6] ..... B32B 3/04; B65D 85/48

[52] U.S. Cl. ..... 428/122; 428/182; 428/184; 428/213; 206/453

[58] Field of Search ..... 428/182, 186, 428/120, 122, 34.2, 119, 172, 184, 192, 213; 206/453

[56] References Cited

U.S. PATENT DOCUMENTS

| | | | |
|---|---|---|---|
| 2,068,771 | 3/1937 | Sherman | 206/454 |
| 2,885,139 | 5/1959 | Werner et al. | 229/14 |
| 2,896,833 | 7/1959 | Markham | 206/454 |
| 2,896,883 | 7/1959 | Markham | 206/454 |
| 3,335,932 | 8/1967 | Brown | 229/14 |
| 4,529,091 | 7/1985 | Martin | 206/586 |

*Primary Examiner*—Donald Loney
*Attorney, Agent, or Firm*—Steven J. Hultquist

[57] ABSTRACT

An edge protector for use in particular on generally flat-faced, panel-like articles such as doors, worktops, tabletops and the like, and to the articles when fitted with the edge protector. The edge protector is of "U-section", the sides of said "U-section" being thinner than the base, the said sides and at least a part of the base being formed from a single length of semi-rigid paper, said base including at least one extra piece of paper located between the said sides, characterised in that the said single length is of corrugated paper and in that the fluting of the corrugations runs laterally around the "U-section".

11 Claims, 2 Drawing Sheets

EDGE PROTECTOR AND FITTED ARTICLE

FIELD OF THE INVENTION

This invention relates to an edge protector and fitted article, and relates in particular to an edge protector for use on generally flat faced, panel-like articles such as doors, worktops, tabletops and the like (herein referred to as articles), and to articles fitted with such an edge protector.

BACKGROUND TO THE INVENTION

During or following manufacture, it is customary for several articles as defined above to be laid horizontal, and stacked one above another, to await removal to the next stage or to store, or ready for delivery to a customer.

If the articles are stacked for long-term storage i.e. they are likely to be long held in store, they may sag or warp, and it is desirable that the articles be closely stacked so that the degree of sagging of an articles can perhaps be limited by the article below. Furthermore, if stack height is critical, then if they are more closely stacked extra articles can be stored or transported "as a stack".

The peripheral edges, however, of the articles are at risk from damage both during storage and transportation, and it is customary for the manufacturer, and often also the customer, to require an adequate thickness of article edge protection designed to reduce the likelihood, and/or severity, of any such damage.

It will be understood that although a desired edge protector shape may readily nowadays be formed in a plastics material, users are increasingly conscious of the environmental implications and the public reaction to the plastics disposal problem, particularly for "one trip" packaging materials. Many currently available edge protectors are manufactured from moulded polystyrene or polyethylene, but users have for some years been actively seeking environmentally acceptable alternatives; specifically, in a technical area in which recycled or recyclable materials may easily be employed, many manufacturers and users are increasingly resisting the use of materials which are not and/or may not be recycled, and instead would prefer to use recycled materials if of the same or similar cost and performance.

A known recyclable material is corrugated paper, such as single-faced corrugated paper in which one corrugated sheet is adhered at the corrugation peaks to a sheet of substantially planar paper. The single-faced corrugated paper thus has on one side parallel exposed fluting running in a selected direction (transverse to the rolled direction of formed paper); such corrugated paper is flexible about mould lines parallel to the fluting.

Another form of corrugated paper, known as "board", has one corrugated sheet to which is adhered two sheets of substantially planar paper, i.e. with one planar sheet adhered to each respective side of the corrugated sheet.

DISCLOSURE OF THE PRIOR ART

One known design of edge protector is a hollow tube of impact absorbent material, cut to length and with a split along its length. In use, the split tube is opened out, so that the "part-circular" edge protector may be placed around the edge of the article. A first disadvantage of this arrangement is that the tube wall needs to be of significant thickness to provide adequate edge protection, and this then means that the (vertical) gap between the stacked articles is greater than needed. A second disadvantage is that the tube may inadvertently split as its facing edges are opened to embrace the article edge.

Many currently available edge protectors are formed with fold-lines as "U-section" lengths, designed so that the sides of the "U" lie between adjacent stacked articles, whilst the base of the "U" fits around, and so provides protection for, the peripheral edge. But they suffer the same first disadvantage as the circular edge protector above. Thus one known design of "recycled material" edge protector is of "U-section", pressed from a flat multi-layered paper, with therefore the sides and base of the "U" being of similar thickness to that of the base. The paper used is "semi-rigid", defined herein as foldable but adapted thereafter to substantially retain its folded shape.

U.S. Pat. No. 2,068,771 discloses an edge protector of "L-section", which is manufactured as a "U-section" then cut in two. The edge protector is manufactured from multi-layer corrugated board. In one disclosed embodiment, the fluting of the corrugations run laterally around the "U-section". The "sides(s)" of the edge protector is/are the same thickness as the "base".

In a modified arrangement, with the "U-section" formed from a single piece of folded (semi-rigid) cardboard, adjacent to the base and extending between the opposed sides are added (three) further layers of semi-rigid cardboard, whereby to thicken the base as compared to the side walls. This known design can meet two of the desirable criteria in that it is of recyclable material, and that the sides of the "U-section" allow the stacked articles to lie closely together, whilst the thickened base provides the required edge protection.

It has also however been a longstanding request from many users that the edge protector be suited to be made from a single length strip, mouldable at the workstation to fit around article curves or corners, and this has now become a third desirable criterion. In particular "individual lengths" of edge protector are a nuisance to handle, and a "length" already fitted may become detached as another "length" is fitted to another part of the article periphery. Also, the article corners are in particular still at risk from inadvertent damage, and need a dedicated edge protector, not simply lengths of adjacent straight edge protectors hopefully fitted to overlap at the corner, even where this possible.

"Continuous" edge protection is thus not only desirable for circular articles, such as round tabletops, but also articles having a rectangular periphery, with corners, such as doors.

None of the designs of edge protector (of recyclable material, and of thinner sidewalls than base) of which we are aware are able to satisfy this third (transverse) "mouldability" requirement. They have substantially rigid sides which when worked to conform to a "non-straight" article edge do not bend progressively, but rather tend to break or deform substantially, often at irregular spacings along their length; these substantial discontinuities are known to result in raised side portions, which then provide an uneven surface upon which the next-stacked article must rest, unevenly, possibly inducing warping.

DISCLOSURE OF THE INVENTION

We seek to provide an edge protector of "U-section", in which the sidewalls are each of lesser wall thickness than the edge-protecting base, which can be moulded to fit a non-linear periphery at the workstation, and which yet is of a recycled (or recyclable) material, preferably a paper-based material. Usefully the edge protector will be supplied in linear sections cut to the lengths required by the user, but alternatively standard sections can be supplied to be cut to the required lengths at the workplace.

We thus propose an edge protector which overcomes or reduces the problems associated with the known designs outlined above. Surprisingly, we are the first to recognise we believe that a characteristic long known to the industry as desirable during manufacture (ease of bending parallel to the fluting for ease of rolling-up in long lengths about a concentric former) can also be of advantage in service to help solve the stated problem.

It is a feature of our invention that we provide an edge protector of "U-section" and having a base and opposed sides, the sides of said "U-section" being thinner than the base, the said sides and at least part of the base being formed from a single length of semi-rigid paper, said base including at least one extra piece of paper located between the said sides, characterised in that the said single length is a single layer of corrugated paper in that said one extra piece of paper is of corrugated paper, and in that a fluting of the corrugations of said single length runs laterally around the U-section, and a fluting of said extra piece runs parallel to said base and substantially perpendicular to said sides.

Conveniently, the corrugated paper is single-faced, though in less preferred embodiments board as herein defined may be used. If single-faced corrugated paper is used, preferably the exposed fluting faces outwardly of the U-section, but for particular applications the fluting can face inwardly to engage the article.

The opposed sides of the U-section, being of single-faced cardboard, with transverse mould lines provided by the fluting hollows, will readily "concertina" when folded with the base, and so allow the edge protector to bend progressively so as to conform to a non-straight article edge, or article corner.

Preferably, the further layers of corrugated paper added between the opposed sides to thicken the base portion are also single-faced, arranged with their fluting running laterally i.e. across the base of the "U-section", from one opposed side to the other.

The dimensions of the edge protector may be chosen such that the distance between the inside faces of the opposed sides of the "U-section" is substantially the same as or perhaps slightly less than the thickness of the article, for a friction grip, permitting the edge protector to remain attached to the article once it is in place, even if that article is transported singly. Alternatively, or additionally, the sides of the "U-section" may be inwardly-angled.

We also provide an article fitted with an edge protector according to the invention.

An additional problem with many of the currently known designs of edge protector is that they occupy a large volume during despatch to a customer, the sides and base enveloping a substantial volume of air; thus the known designs are manufactured to be semi-rigid, so that once made they cannot easily be folded to reduce their volume.

It is a further feature of our invention that we provide an edge protector of "U-section", the sides of the said "U-section" being thinner than the base, the said sides and a part of the base being formed from a single piece of semi-rigid paper, said base comprising further layers of paper, characterised in that the edge protector is of two-part construction, and in that one part comprises pieces connected to form an aperture at the base, and in that the other part is the said further layers wherein the said further layers are removable from the aperture whereby the sides of said U-section can be folded substantially parallel to the base. Preferably the aperture is between the outermost part of the base and a cross-piece extending between the sides; and that the sides of the U-section and the aperture section may be folded flat together.

BRIEF DESCRIPTION OF THE DRAWINGS

The invention will be further described, by way of example, with reference to the accompanying drawings, in which.

DESCRIPTION OF THE EXEMPLARY EMBODIMENTS

Figure 1:
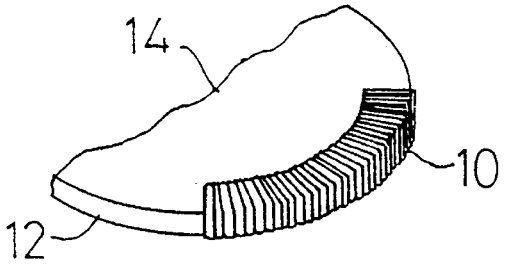
FIG. 1 is a perspective view of an edge protector according to the invention fitted to a part of a non-straight article edge.

In FIG. 1, the edge protector 10 is fitted to part of edge 12 of the article 14. The article 14 is lying flat, prior to other edge protectors being fitted to its remaining, unprotected, edge(s), and then being stacked with similar articles prior to storage or transportation. In an alternative embodiment, a single edge protector may protect the whole of the peripheral edge of the article.

Figure 2:
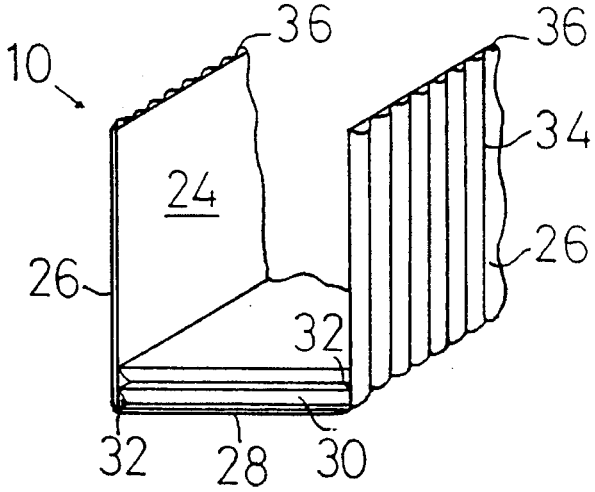
FIG. 2 is a perspective view of part of the edge protector of FIG. 1.

The edge protector 10 is of single-faced corrugated paper (FIG. 2), and comprises a single sheet 24, bent into a U-section with the exposed flutes facing outwardly. The sheet 24 has two sides 26 and a base portion 28, which connects the opposed sides 26.

Between the side walls 26 and to base portion 28 are affixed further layers of corrugated paper 30, which in this embodiment are also single-faced. Preferably there are two further layers of corrugated paper 30, bonded at their edges 32 to the sides 26, thus helping maintain the form of the U-section in use. In an alternative embodiment, the further layers 30 may be adhesively bonded together, and to the base portion 28 of sheet 24.

In this embodiment, the flutes 34 of the corrugated paper face to the outside of the U-section, and the flutes of the further layers 30 face towards the base portion 28, so that in use a flat face of corrugated paper can lie alongside each adjacent face of the article, to reduce the risk of damage to the article, for example from scratches by debris resting between the flutes 34.

In a preferred embodiment, the sides 26 of the edge protector are formed to converge slightly towards their free ends 36, so that, when fitted to an article, the resilience in the opposed sides (parallel to the flutes 34) allows the ends 36 frictionally to grip the article, to help prevent the edge piece inadvertently dislodging from the article.

The flutes 34, which run laterally with respect to the U-section, allow the edge protector 10 to be fitted to a non-straight article edge, since the flutes 34 of the opposed sides will readily "concertina" or otherwise mould to shape to conform within wide limits to the edge profile i.e. as followed by base portion 28.

When the edge protector is properly fitted, for instance to a tabletop which is round in plan view, the resulting "peripheral" length of the free ends 36 (of the sides 26) will be shorter than the peripheral length assumed by the base portion 28.

The amount by which the edge protector will be able to bend will be determined in part by the thickness of the paper from which the corrugated paper is made, by the number and disposition of the flutes, and also by the number of further layers 30. Each of these can be chosen by the supplier to ensure good conformity of the edge protector to a particular article or range of articles. The number of layers 30 will usually be selected first, in accordance with the edge protection required.

Figure 3:
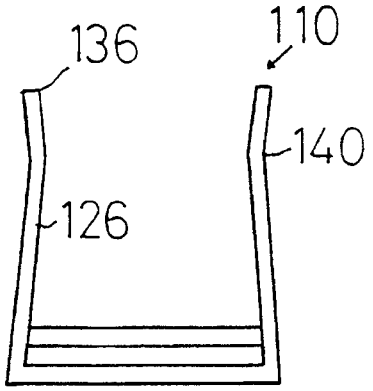
FIG. 3 is an end view of an alternative embodiment of edge protector.

FIG. 3 is of an alternative embodiment of edge protector 110; in this embodiment, the sides 126 are kinked along longitudinal fold lines 140, so that the ends 136 are spaced further apart than the thickness of the article, and so provide a lead-in, whereby to allow the edge protector 110 to be more easily and/or quickly fitted to the article. In this embodiment, the friction grip between the edge protector 110 and the article is provided by the side regions adjacent the fold lines 140. The degree of convergence towards fold line 140 may be chosen in accordance with the friction grip required by the article manufacturer.

Figure 4:
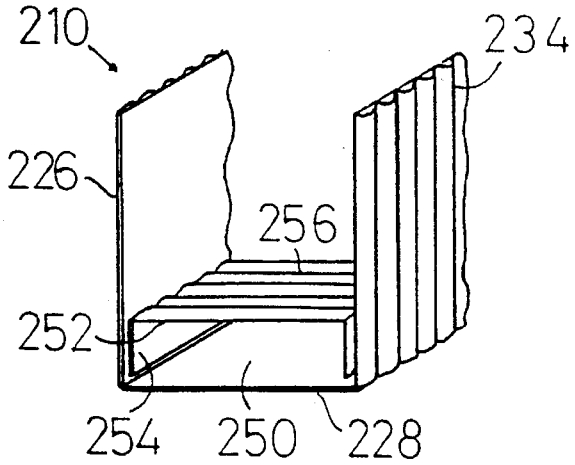
FIG. 4 is a perspective view of a part of a foldable edge protector according to the invention.
Figure 5:
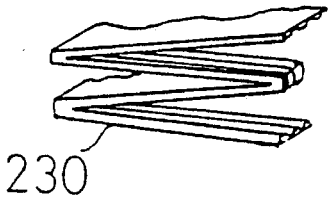
FIG. 5 is an end view of further layers of corrugated paper forming part of the foldable edge protector.
Figure 6:
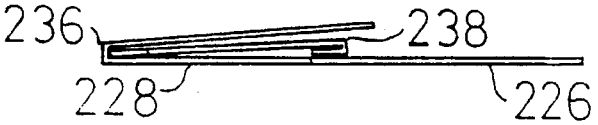
FIG. 6 is an end view of the part of the foldable edge protector of FIG. 4, in the folded condition.

FIG. 4 shows part of an embodiment of edge protector which may be flattened for transportation i.e. to the condition of FIG. 6. In this embodiment of edge protector the further layers 230 (FIG. 5) if required in use can be removably located within longitudinal aperture 250 in edge protector part 210 (FIG. 4). Aperture 250 is formed between the base portion 228 and cross-piece 252. In this embodiment, cross-piece 252 is itself of single-faced corrugated paper, and is bent into the form of a "U", the sides 254 of this "U" being adhesively bonded to inner wall parts of the sides 226.

To assist insertion and removal of the further layers 230, in this embodiment the cross-piece 252 has its flat surface towards the aperture 250, so that its flutes 256 in use face the edge of the article. The likelihood, however, of debris lodging between the flutes 256 (which are vertical in use e.g. FIG. 1) is small, and in any case the likelihood of damage being caused to the article by any such lodged debris is reduced because the (vertical) protected edge is not a load bearing surface in the stack of articles, so that the arrangement of this embodiment may be acceptable for some manufacturers. However, in an alternative embodiment the flutes may face the aperture.

Suitably sized further layers 230, which in the embodiment of FIG. 5 are formed by folding a single layer of single-faced corrugated paper across the flutes, may be inserted by the user into and along the aperture 250, when the edge protector is in the erected condition of FIG. 4, to provide the degree of strength and edge protection required. However, some users may be satisfied with the level of protection afforded by the edge protector part 210 alone, and not require the use of further layers 230.

For despatch to the customer (starting from the condition shown in FIG. 4), a lateral or shear force is applied to the two sides 226 to cause the edge protector part 210 to collapse into the substantially flat condition of FIG. 6.

Further fold lines 236,238 are usefully introduced to help allow the "folded" edge protector part 210 to lie flat, yet without serious distortion of the flutes 234.

It will thus be understood that with this modification both the edge protector part 210, and the further layers 230, may be transported efficiently, with little or no "wasted space" or non-protector material volume, but may readily be assembled into a functional edge protector at the workplace.

Figure 7:
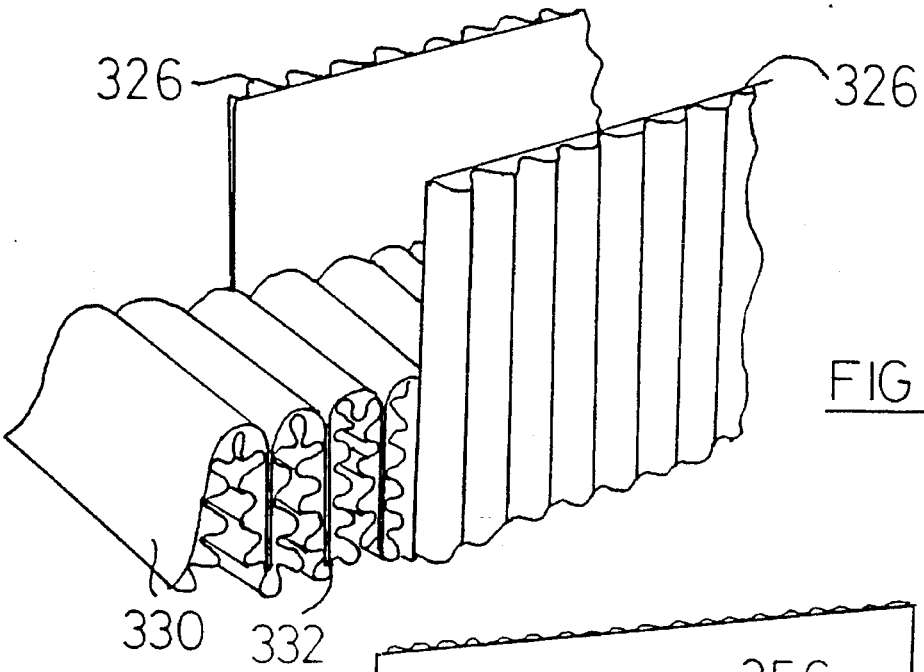
FIG. 7 is a perspective view of part of another embodiment.
Figure 8:
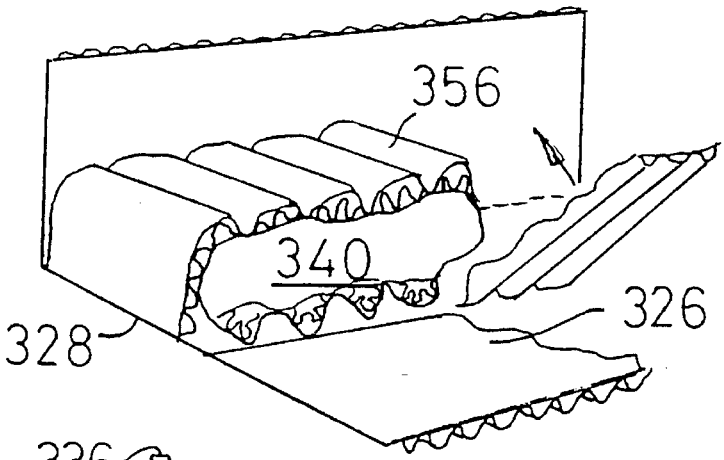
FIG. 8 is a view corresponding to that of FIG. 7, during assembly.
Figure 9:
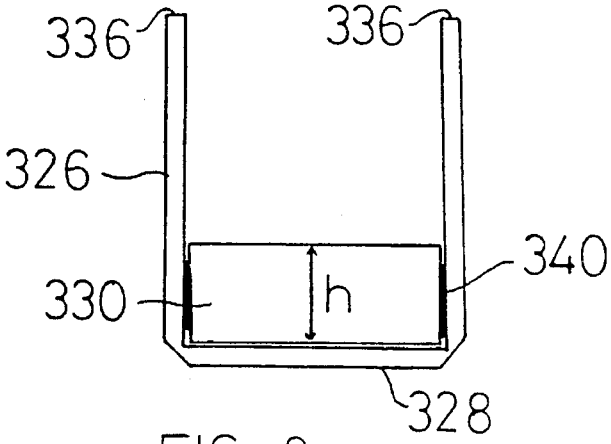
FIG. 9 is an end view of the assembled edge protector of FIG. 7.

The embodiment of FIGS. 7–9 can also be transported either flat (or substantially flat) for erection at the workplace, or ready-assembled. In this embodiment the single-faced supplementary corrugated paper 330 also, as in the FIG. 4 embodiment, has its flutes 356 running across (lateral to) the lengthwise direction of the protector 10, but the paper is repeatedly folded back upon itself to form a thickened strip of corrugated paper. The edges 332 of the folded paper 330 are secured to the inner (facing) wall parts of the sides 326, as by adhesive 340 (FIG. 8).

If the edge protector of this embodiment is to be erected at the workplace, it is envisaged that the supplementary corrugated paper 330 be pre-assembled into the reversed-folded condition of FIGS. 7,8, and supplied as a ready-made filler piece; this filler piece may then be inserted into the U-section formed at the workplace, the sides 326 of the U-section being secured to the pre-folded paper 330 by adhesive 340.

The supplementary corrugated paper "filler piece" 330 can have a selected height "h" (FIG. 9), to provide the degree of edge protection, or cushioning, required by the article manufacturer.

In the embodiment of FIG. 9, the length of the inside face of base portion 328 is slightly longer than the width of the supplementary corrugated paper "filler piece" 330. The adhesive 340, suitably of latex or PVA, acts both to secure the sides to the filler piece and to fill the gap between the paper 330 and the sides 326. In a preferred embodiment the sides 326 are arranged to converge towards their free ends 336 to provide an additional friction grip between the edge protector and the fitted article. It will be understood that varying the height, "h", and the quantity of adhesive 340 applied, can be used to vary the spacing between ends 336.

Although we prefer the use of single-faced corrugated paper, in alternative embodiments board can be used instead of some or all of such paper.

I claim:

1. An edge protector comprising a first base element between and contiguous with two opposed sides thereby defining a U-section shape, wherein the sides of the edge protector are thinner in width than the base, the sides and the first base element are formed from a single layer of semi-rigid paper, said edge protector includes at least one auxiliary base element comprised of a piece of semi-rigid paper located between the sides, said semi-rigid paper is corrugated paper and a fluting of the corrugations of the single layer runs laterally around the edge protector, and a fluting of the corrugations of the piece of semi-rigid paper runs parallel to the first base element and substantially perpendicular to the sides.

2. An edge protector according to claim 1, wherein the corrugated paper is single-faced, and the fluting faces outwardly of the edge protector.

3. An edge protector according to claim 1, wherein the auxiliary base element comprises at least two layers of single-faced corrugated paper adhered together and adhered to the sides of the edge protector.

4. An edge protector according to claim 1, wherein the auxiliary base element is of single-faced corrugated paper reverse-folded back upon itself to form a thickened strip, the strip being adhered to the sides of the edge protector.

5. An edge protector according to claim 4, wherein the strip is adhered to the sides by one of latex and PVA.

6. An edge protector according to claim 1, wherein the piece of semi-rigid paper is a layer of corrugated paper having a part in the erected condition of the edge protector spaced from the first base element, thereby defining an aperture between the first base element and the part, and wherein the edge protector may be folded substantially flat with said part alongside the first base element.

7. An edge protector according to claim 6, wherein further layers of corrugated paper are removably located within the aperture.

8. An edge protector according to claim 1, wherein the sides of the edge protector converge, being more closely spaced together at a point away from the base than at the base, and wherein the sides are longitudinally kinked whereby to provide a lead-in for an article to which the edge protector is to be fitted.

9. An article fitted with an edge protector according to claim 1.

10. An article fitted with an edge protector according to claim 1, wherein the sides of the edge protector are spaced apart by a distance less than the thickness of the article so that there is a friction grip between the edge protector and the article.

11. An edge protector, comprising:

(a) a first base element between and contiguous with two opposed sides thereby defining a U-section shape, wherein:

the sides and the first base element are both of single layer semi-rigid paper, and are formed from a single length of semi-rigid paper, and fluting of the corrugations of the single layer semi-rigid corrugated paper runs laterally around the edge protector, and (b) at least one auxiliary base element comprised of a piece of semi-rigid corrugated paper is located between the sides, having a fluting of the corrugations of the piece of semi-rigid paper running parallel to the first base element and substantially perpendicular to the sides of the planar first base element, with the at least one auxiliary base element and the first base element together forming a base of the edge protector, and wherein the sides of the edge protector are thinner than the base.

* * * * *